US008256153B1

(12) United States Patent
Noha et al.

(10) Patent No.: US 8,256,153 B1
(45) Date of Patent: Sep. 4, 2012

(54) LASER SIGHTING DEVICE

(76) Inventors: Donald D. Noha, Virginia Beach, VA (US); Clarence L. Garvin, Jr., Virginia Beach, VA (US)

( * ) Notice: Subject to any disclaimer, the term of this patent is extended or adjusted under 35 U.S.C. 154(b) by 300 days.

(21) Appl. No.: 12/661,511

(22) Filed: Mar. 18, 2010

Related U.S. Application Data

(60) Provisional application No. 61/210,491, filed on Mar. 18, 2009.

(51) Int. Cl.
*F41G 1/35* (2006.01)

(52) U.S. Cl. ..... 42/117; 42/114; 362/110

(58) Field of Classification Search ..... 42/114, 42/115, 116, 117, 146; 362/110, 112
See application file for complete search history.

(56) References Cited

U.S. PATENT DOCUMENTS

| | | | | |
|---|---|---|---|---|
| 3,813,790 | A | 6/1974 | Kaltmann | |
| 4,939,863 | A | 7/1990 | Alexander et al. | |
| 5,033,219 | A | 7/1991 | Johnson et al. | |
| 5,299,375 | A | 4/1994 | Thummel et al. | |
| 5,301,594 | A | 4/1994 | Argazzi et al. | |
| 5,432,598 | A | 7/1995 | Szatkowski | |
| 5,531,040 | A * | 7/1996 | Moore | 42/115 |
| 5,584,137 | A * | 12/1996 | Teetzel | 42/117 |
| 5,584,569 | A | 12/1996 | Huang | |
| 5,694,713 | A * | 12/1997 | Paldino | 42/115 |
| 5,704,155 | A * | 1/1998 | Primeau, IV | 42/114 |
| 5,988,038 | A | 11/1999 | Feintuch | |
| 6,366,344 | B1 | 4/2002 | Lach | |
| 6,408,731 | B1 | 6/2002 | Elsener | |
| 6,693,702 | B2 | 2/2004 | Rogers | |
| 6,793,494 | B2 | 9/2004 | Varshneya et al. | |
| 6,823,600 | B1 | 11/2004 | Vaughan | |
| 6,889,594 | B2 | 5/2005 | Ebersole, Jr. et al. | |
| 6,988,331 | B2 | 1/2006 | Holmberg | |
| 7,954,273 | B1 * | 6/2011 | Swan | 42/115 |
| 2002/0046479 | A1 * | 4/2002 | Rogers | 42/114 |
| 2006/0026888 | A1 * | 2/2006 | Cheng et al. | 42/146 |
| 2006/0144216 | A1 | 7/2006 | Shipman et al. | |
| 2007/0039225 | A1 * | 2/2007 | Kallio et al. | 42/146 |

* cited by examiner

*Primary Examiner* — Bret Hayes
(74) *Attorney, Agent, or Firm* — Wooten & Shaddock, PLC

(57) ABSTRACT

A laser sighting device having a laser sight body with a barrel aperture formed through the laser sight body; two or more laser emitter apertures formed in the laser sight body; a laser light aperture extending from a bottom wall of each laser emitter aperture through the laser sight body; a laser emitter for each laser emitter aperture; wherein a laser emitter is fitted within each laser emitter aperture; a cap associated with each laser emitter aperture; wherein when the cap is a threadedly connected and sufficient torque is applied to the cap, the laser emitter produces a laser light beam that is projected through the laser light aperture.

20 Claims, 10 Drawing Sheets

LASER SIGHTING DEVICE

CROSS-REFERENCE TO RELATED APPLICATIONS

This application claims priority from U. S. Provisional Patent Application Ser. No.: 61/210,491, filed Mar. 18, 2009, the disclosure of which is incorporated herein by reference.

BACKGROUND OF THE INVENTION

1. Field of the Invention

This invention is drawn generally to a laser sighting device. More specifically, the present invention is drawn to a laser sighting device that parallels a bore or barrel on multiple sides, projecting a pattern of laser points, lines, or patterns, which aid in sighting in of a target.

2. Description of Related Art

The Percussion Actuated Non-Electric (P.A.N.) Disrupter is a standard weapon that all FBI accredited bomb squad's possess. Existing line-of-sight laser bore sights for the P.A.N. disrupter consist of a single laser secured in a laser sight body that is affixed to the end of the disrupter barrel and secured by mechanical pressure (set screw) or by magnetic attraction. This method obstructs the barrel and causes unnecessary wear and damage to the barrel end.

Existing technology requires the user to physically remove the laser bore sight from the end of the barrel after the target has been acquired, thus creating potential problems. In the high-stress environment of hazardous device render safe operations, the user must remember to remove the laser sight from the barrel before using the P.A.N. disrupter. Failure to remove the laser sight from the barrel before use would require the user to re-approach a hazardous device or cause the destruction of the laser sight if the weapon were to be fired with the sight still in place. Removal of the laser sight from the end of the barrel has the potential to inadvertently move the barrel, thus causing the shot to miss the intended target.

Where the P.A.N. disrupters are mounted on a hazardous duty robot, current technology requires use of lasers, which are offset from the bore, adjacent to the barrel.

SUMMARY OF THE INVENTION

Any time a laser is mounted external to a bore or barrel so as to be utilized as a sighting device, whether the bore or barrel is for a P.A.N. disrupter or any other firearm, tool, or device, the configuration causes a triangulation/parallax effect. The laser does not parallel the bore and therefore can only be accurately sighted in at a single, known distance.

The user of a robot-mounted P.A.N. disrupter does not have the luxury of accurate depth perception during remote operation of the robot. If the distance is closer or farther back from the known sighted distance, then a shot from the P.A.N. disrupter will not be accurate. Additionally, bore obstructing laser sights cannot be used, as they are unable to be removed from a remotely operated robot.

The present invention relates generally to a laser sighting device. More specifically, the present invention is drawn to a laser-sighting device that parallels a bore or barrel on multiple sides, projecting a pattern of laser points, lines, or patterns, which aid in sighting in of a target.

In various exemplary, non-limiting embodiments, the laser sighting device utilizes four laser emitters set in a laser sight body designed to fit on the barrel of the P.A.N. disrupter. The laser sight body slides onto the barrel.

In various exemplary, non-limiting embodiments, each of the laser emitters is secured within a laser emitter aperture formed in the laser sight body so as to initially prevent the laser emitters from making the metal-to-metal contact required to activate the laser emitters. Non-conductive cap screws, which can be used to apply pressure to the laser emitters, are used to secure the laser emitters within the laser emitter apertures. When the cap screws are tightened, pressure is applied to the rear of the laser emitters, the laser emitters are urged deeper into the laser emitter apertures, and metal-to-metal contact is made to activate the laser emitters.

Each of the lasers, when illuminated, projects a beam that is parallel to the bore of the barrel through four equally spaced laser light apertures in the laser sight body. The resulting pattern of projected laser points dependent on the number and arrangement of the laser emitters and the orientation of the laser sight body as mounted on the barrel. By paralleling the bore, the projected laser pattern remains consistent regardless of the range distance. This eliminates the triangulation/parallax effect.

In various exemplary, non-limiting embodiments, prismatic optical enhancements or line generating laser emitters may be used to project a "crosshair" or other pattern.

In certain exemplary, non-limiting embodiments, line generating laser emitters that project an arc may be combined so that four arcs connect and form a circle. It should be appreciated that any geometric shape that can be produced by laser enhancement may be employed. The projected laser beam(s) may be of any color and/or intensity. The number and pattern of laser emitters set into the laser sight body may vary and is not limited to a certain minimum or maximum number.

In various exemplary, non-limiting embodiments, the compression-activated laser emitters are replaced by laser emitters that are controlled by electric, electro-mechanical, or mechanical switches. Laser emitters that have an external power source and/or operational control switches, are also suitable for use in the laser sighting device.

An additional embodiment of the laser sighting device includes the application of high intensity Light Emitting Diodes (LED) in the alternate spaces between the existing laser emitters inside the laser sight body. These LED's may be of all white light in the visible spectrum, of various colors, or in the infrared spectrum. This embodiment allows the target to be visually illuminated thus aiding in the acquisition of proper sight alignment.

Standard Picatinny rails may be machined on the outside of the laser sight body to accommodate additional accessories.

Accordingly, this invention provides a laser sighting device, which projects a pattern that remains consistent regardless of the range distance from the laser sighting device to a target.

This invention separately provides a laser sighting device, which eliminates the triangulation/parallax effect.

This invention separately provides a laser sighting device, which does not obstruct the bore.

This invention separately provides a laser sighting device, which does not need to be removed when the device is fired or discharged.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE PREFERRED EMBODIMENT

Figure 1:
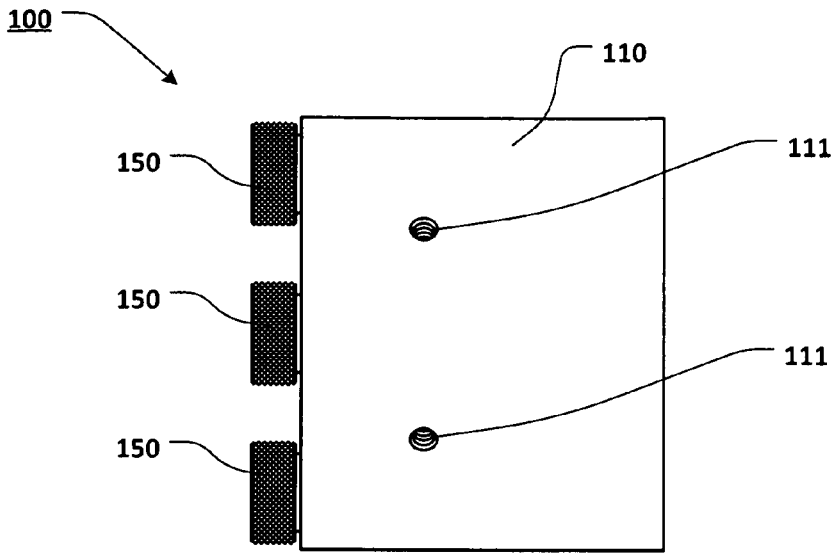
FIG. 1 shows a side view of a first illustrative, non-limiting embodiment of an exemplary laser sighting device according to this invention.
Figure 2:
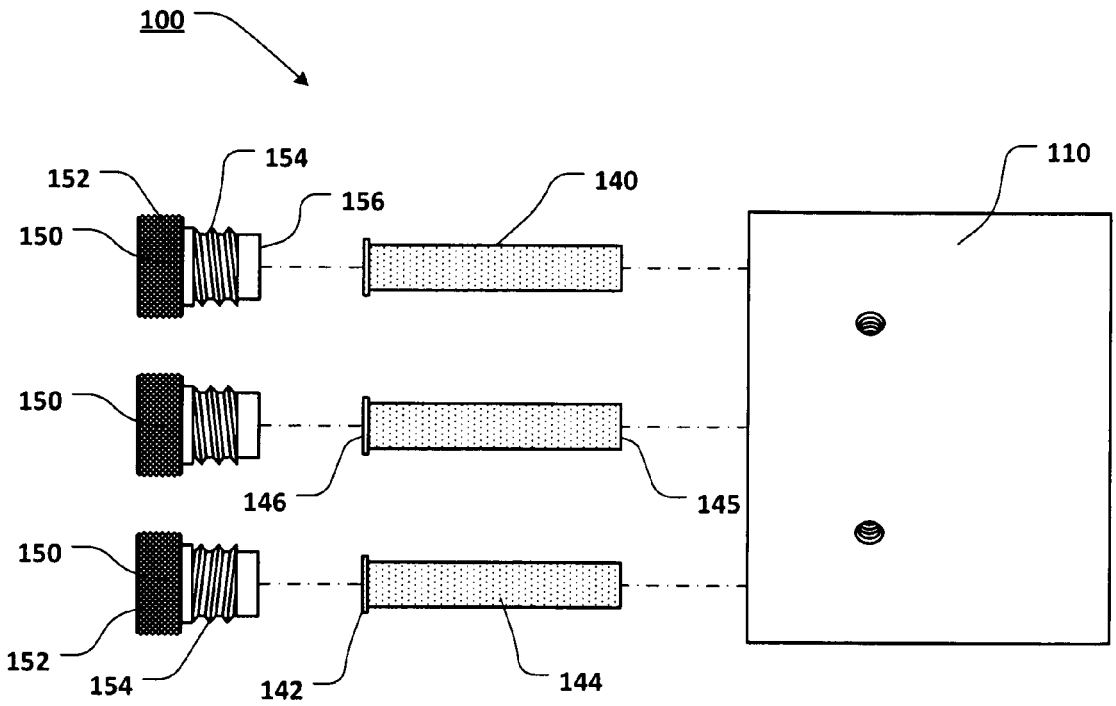
FIG. 2 shows an exploded side view of the first illustrative, non-limiting embodiment of an exemplary laser sighting device according to this invention.
Figure 3:
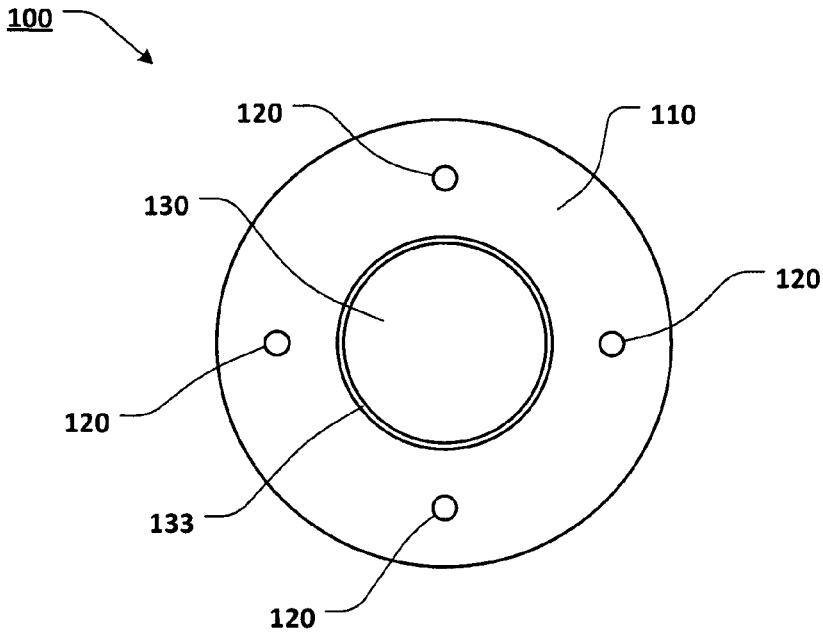
FIG. 3 shows a front view of the first illustrative, non-limiting embodiment of an exemplary laser sighting device according to this invention.
Figure 4:
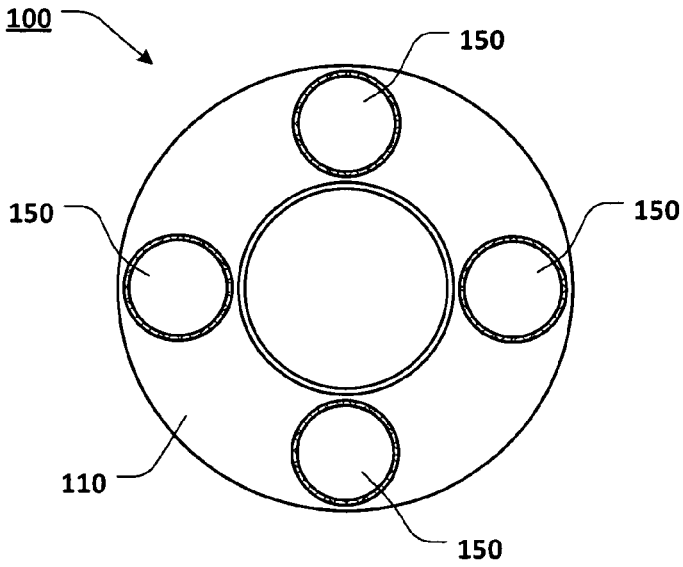
FIG. 4 shows a rear view of the first illustrative, non-limiting embodiment of an exemplary laser sighting device according to this invention.
Figure 5:
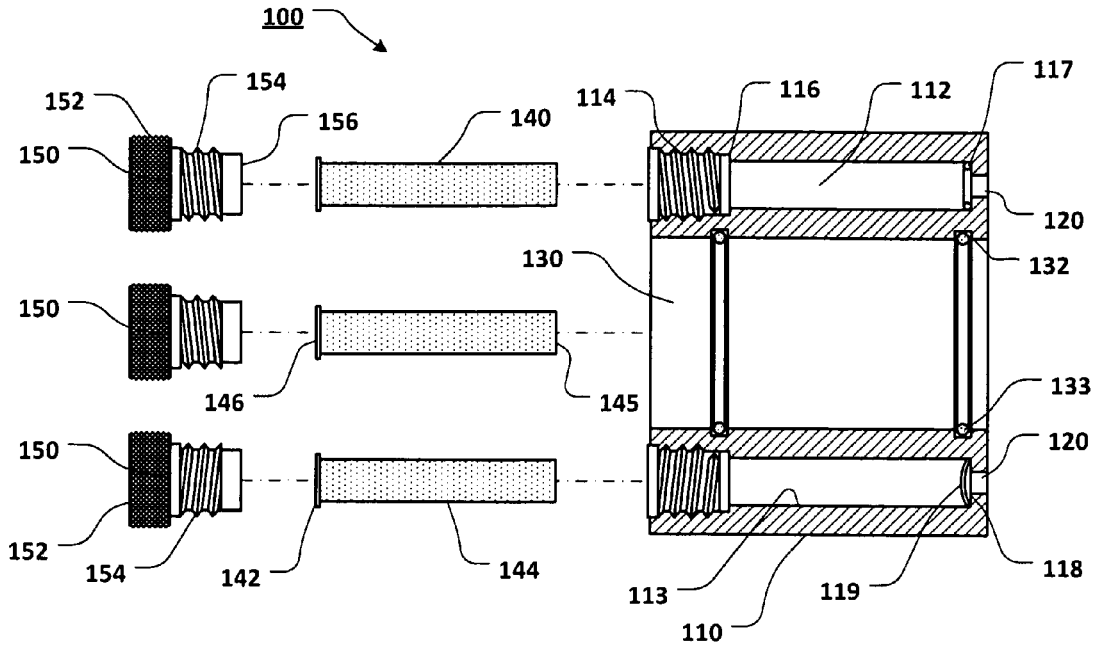
FIG. 5 shows an exploded cross-sectional view of the first illustrative, non-limiting embodiment of an exemplary laser sighting device according to this invention.
Figure 6:
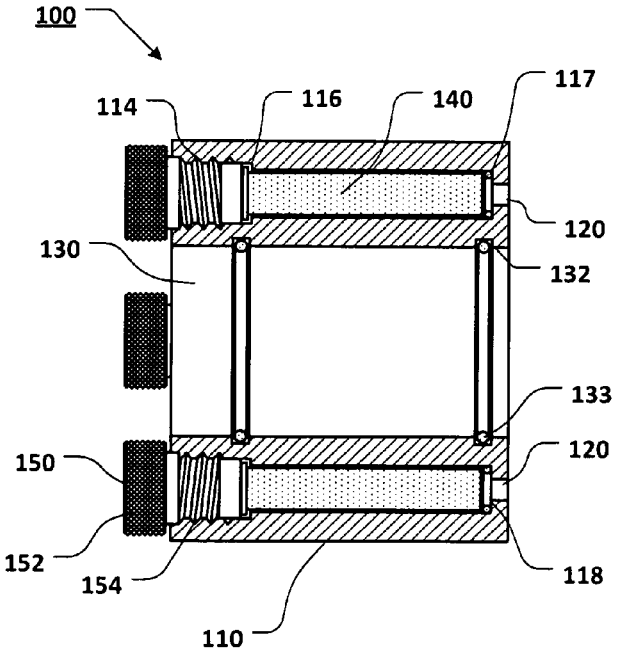
FIG. 6 shows a cross-sectional view of the first illustrative, non-limiting embodiment of an exemplary laser sighting device, wherein the laser emitters are deactivated according to this invention.
Figure 7:
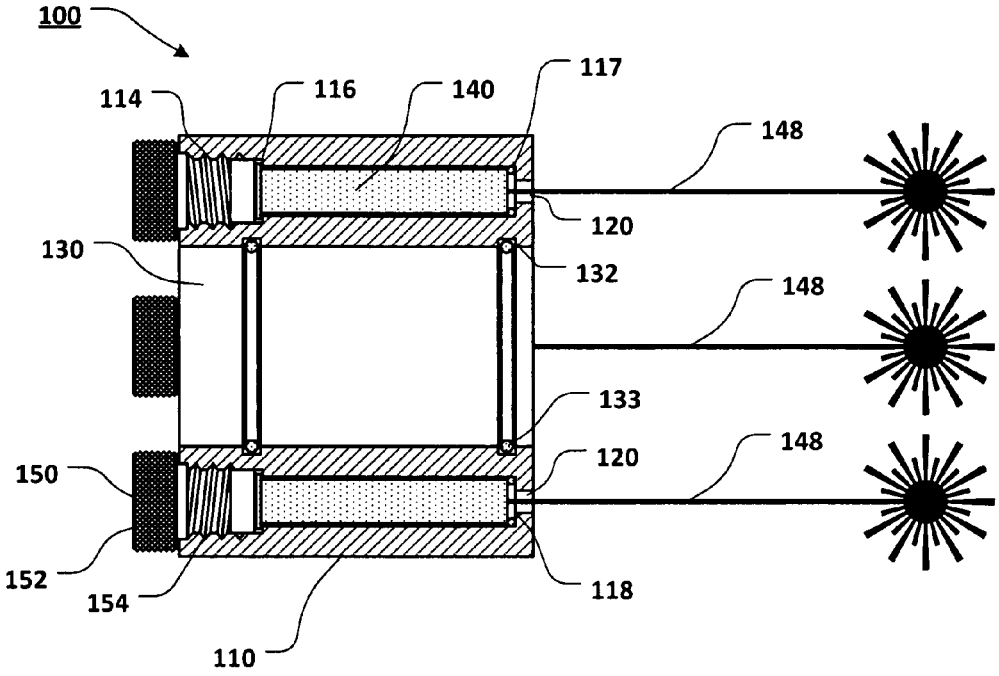
FIG. 7 shows a cross-sectional view of the first illustrative, non-limiting embodiment of an exemplary laser sighting device, wherein the laser emitters are activated according to this invention.
Figure 8:
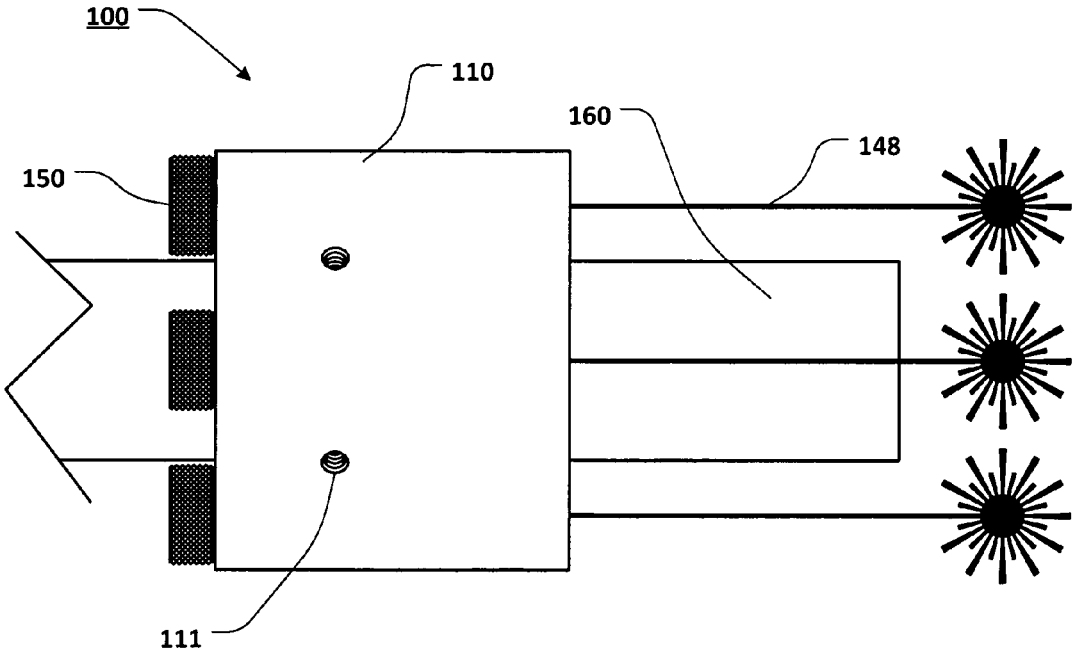
FIG. 8 shows a side view of the first illustrative, non-limiting embodiment of an exemplary laser sighting device, wherein the laser sighting device is positioned on a barrel and the laser emitters are activated according to this invention.

For simplicity and clarification, the design factors and operating principles of the laser sighting device according to this invention are explained with reference to various exemplary embodiments of a laser sighting device according to this invention. The basic explanation of the design factors and operating principles of the laser sighting device is applicable for the understanding, design, and operation of the laser sighting device of this invention.

Furthermore, it should be appreciated that, for simplicity and clarification, the embodiments of this invention will be described with reference to the laser sighting device being used on a generic portion of a barrel. It should be appreciated that the laser sighting device of this invention may be utilized on or around the barrel of a P.A.N. disrupter or any other firearm, weapons system, tool, or device.

It should also be appreciated that the terms "laser sighting device" and "P.A.N. disrupter" are for basic explanation and understanding of the operation of the systems, methods, and/or apparatuses of this invention. Therefore, the terms "laser sighting device" and "P.A.N. disrupter" are not to be construed as limiting the systems, methods, and/or apparatuses of this invention.

Furthermore, where a range of values is provided (such as the number of laser emitters utilized by the laser sighting device), it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding both of those included limits are also included in the invention.

Turning now to the drawing Figs., FIGS. 1-8 show various views of a first illustrative, non-limiting embodiment of an exemplary laser sighting device according to this invention. As illustrated in FIGS. 1-8, the laser sighting device 100 comprises a laser sight body 110, two or more laser emitters 140, and two or more caps 150.

In various exemplary embodiments, the laser sight body 110 is formed, at least in part, of an electrically conductive material, such as, for example, aluminum, and is formed in a generally cylindrical shape having a bore or barrel aperture 130 formed through the approximate center of the laser sight body 110, along the longitudinal axis of the laser sight body 110. The barrel aperture 130 is formed so as to allow the laser sight body 110 to be positioned around a bore or barrel 160 of a P.A.N. disrupter or any other firearm, weapons system, tool, or device.

The laser sight body 110 includes two or more laser emitter apertures 112 formed in the laser sight body 110. Each laser emitter aperture 112 extends from a threaded portion 114 to a shoulder 116 and a bottom wall 118. Each aperture 112 includes a spring biasing means, such as, for example, an O-ring 117 or a spring washer 119 positioned so as to contact the bottom wall 118.

A laser light aperture 120 extends from the bottom wall 118 of each laser emitter aperture 112 through the laser sight body 110. Each laser light aperture 120 is of a sufficient diameter to allow a laser light beam 148 to be projected through the laser light aperture 120 and out of the laser sight body 110.

In various exemplary, nonlimiting embodiments, each laser emitter 140 is a laser bore sight, such as those available from AimSHOT, Bushnell, Leupold, Hoppes, SightMark, or Tasco. Each laser emitter 140 includes a rim 142 and a body 144. The laser emitter 140 is constructed such that the exterior surface of the rim 142 is electrically isolated from the exterior surface of the body 144. When the exterior surface of the rim 142 is electrically connected to the exterior surface of the body 144, the laser emitter 140 is activated and a laser light beam 148 is projected from the laser emitter 140. While laser bore sights are available in a number of sizes and caliber configurations, laser bore sights created to represent rimfire-type cartridges are preferably used with the present invention.

The overall size and shape of each laser emitter aperture 112 is dictated by the size and shape of the particular laser emitter 140 that is to be utilized with the laser sighting device 100. Thus, each laser emitter aperture 112 is formed such that a laser emitter 140 may be fitted within a laser emitter aperture 112.

When a laser emitter 140 is fitted within a laser emitter aperture 112, the exterior surface of the body 144 contacts the side walls 114 of the laser emitter aperture 112. The forward surface 145 of the body 144 contacts the O-ring 117 (or the spring washer 119) at the bottom wall 118 of the laser emitter aperture 112 and the laser emitter 140 is spring biased such that the rim 142 does not make contact with the shoulder 116 of the laser emitter aperture 112.

A cap 150 is associated with each laser emitter aperture 112. Each cap 150 extends from a top portion 152, to a threaded portion 154, to an end surface 156. Each cap 150 is formed such that the threaded portion 154 can be threaded into the threaded portion 114 of the laser emitter aperture 112.

When a laser emitter 140 is fitted within a laser emitter aperture 112 and a cap 150 is a threadedly connected, via the interaction of the threaded portions 154 and 114, the end surface 156 of the cap 150 makes initial contact with the rear surface 146 of the laser emitter 140. If, after the end surface 156 of the cap 150 makes initial contact with the rear surface 146 of the laser emitter 140, sufficient tightening, rotational torque is applied to the cap 150, and specifically the knob portion 152, the resilience or spring bias of the O-ring 117 (or the spring washer 119) at the bottom wall 118 is overcome sufficient to allow the laser emitter 140 be urged deeper within the laser emitter aperture 112.

When the laser emitter 140 has been urged a sufficient distance within the laser emitter aperture 112, the exterior surface of the rim 142 makes contact with the shoulder 116 of the laser emitter aperture 112. Because the laser sight body 110 is formed of an electrically conductive material, when the exterior surface of the rim 142 makes contact with the shoulder 116, and electrical path is created between the exterior surface of the rim 142 and the exterior surface of the body 144 such that the laser emitter 140 is activated and a laser light beam 148 is produced and projected through the laser light aperture 120.

When sufficient loosening, rotational torque is applied to the cap 150, the resilience or spring bias of the O-ring 117 (or the spring washer 119) applies a force to be forward surface 145 of the laser emitter 140, sufficient to allow the laser emitter 140 be urged out of the laser emitter aperture 112 sufficient to break contact between the exterior surface of the rim 142 and the shoulder 116. When the exterior surface of the rim 142 no longer makes contact with the shoulder 116, the exterior surface of the rim 142 is no longer electrically connected to the exterior surface of the body 144 and the laser light beam 148 is deactivated.

In certain exemplary embodiment, the laser emitters 140 comprise four 0.38 caliber laser bore sights that are inserted into the laser emitter apertures 112 and are suspended inside the laser emitter apertures 112 by rubber 'O' rings 117 pushing against the forward surface 145 of the laser emitters 140, preventing electrical contact between the rim 142 and the body 144 of the laser emitters 140. Four non-conductive, plastic caps 150 are tightened to apply pressure to the rear surfaces 146 of the 0.38 caliber laser emitters 140. When the pressure applied to the rear surfaces 146 of the laser emitters 140 is sufficient to overcome the biasing force of the rubber 'O' rings 117, the rims 142 contact the shoulders 116 and complete the metal-to-metal contact required to activate the laser emitters 140.

In various exemplary, nonlimiting embodiments, one or more, and preferably two or more, O-ring receiving grooves 132 is/are formed within the barrel aperture 130. Each O-ring receiving grooves 132 is formed so as to receive at least a portion of an O-ring 133, so as to maintain the O-ring 133 in a fixed position relative to the barrel aperture 130. If included, the O-ring(s) 133 help to stabilize the laser sight body 110 around a barrel 160.

In certain exemplary, nonlimiting embodiments, one or more threaded set screw apertures 111 are formed around the laser sight body 110. The threaded set screw apertures 111, if included, extend radially from the center of the laser sight body 110 and are formed so as to accommodate set screws. By tightening the set screws within the threaded set screw apertures 111, the laser sight body 110 is further stabilized around a barrel 160. The setscrews may also be used for alignment adjustment between the laser sight body 110 and the barrel 160.

Figure 9:
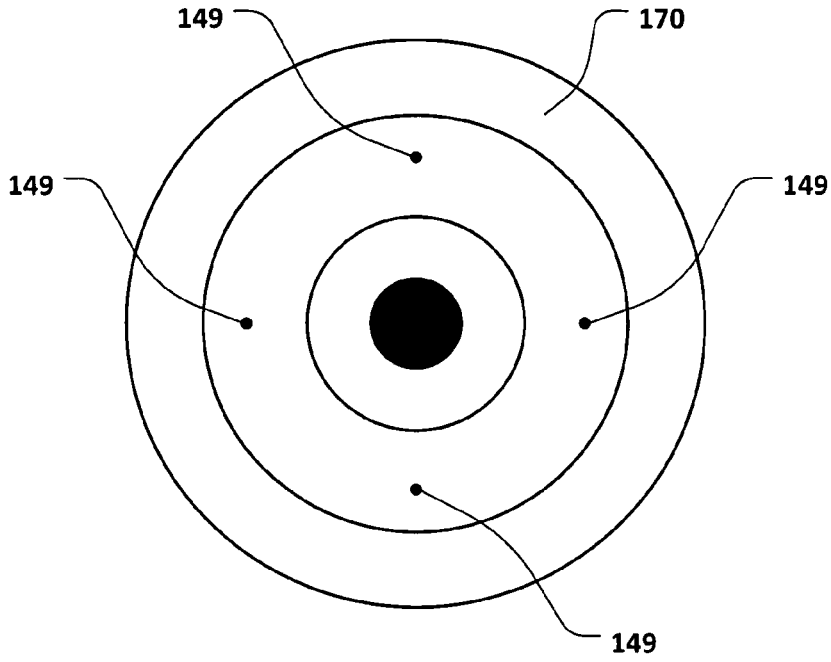
FIG. 9 shows a first illustrative, non-limiting embodiment of an exemplary laser pattern projected on a target according to this invention.

The laser emitter apertures 112 and associated laser light apertures 120 are generally positioned at equally spaced apart positions around the laser sight body 110. Thus, as illustrated in FIG. 9, when each of the laser emitters 140 is activated, a pattern of laser light beams 148 is projected from the laser sighting device 100, resulting in a pattern of laser points 149 being projected onto a target 170. Because each laser emitter aperture 112 is formed so as to parallel the longitudinal axis of the laser sight body 110 and, in turn, the longitudinal axis of the barrel 160, when the laser emitters 140 are activated, the resulting pattern of laser points projected onto the target are spaced equal distance around the center of the longitudinal axis of the barrel 160.

Because the laser light beams 148 paralleled the bore of the barrel 160, the projected laser pattern remains consistent, regardless of the range distance. This eliminates the triangulation/parallax effect.

Figure 11:
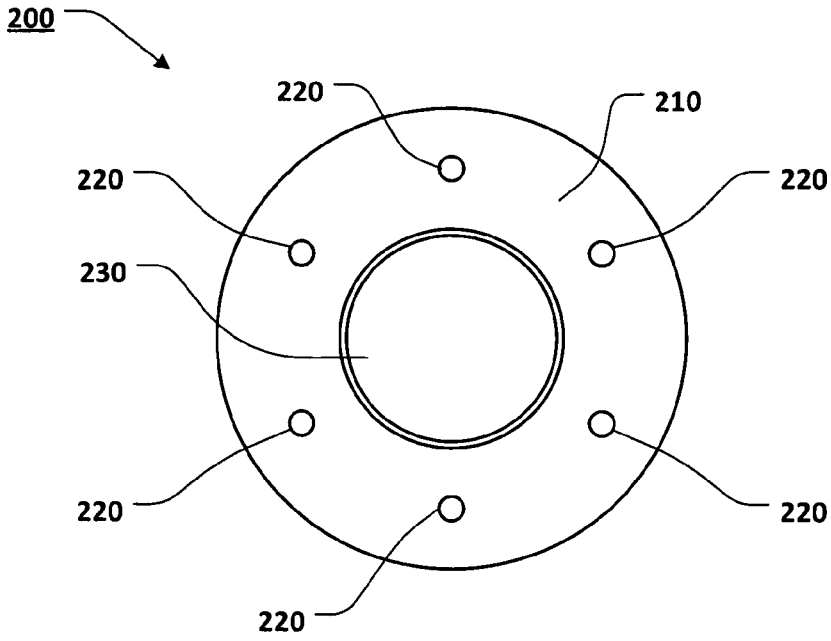
FIG. 11 shows a front view of the second illustrative, non-limiting embodiment of an exemplary laser sighting device according to this invention.

It should be appreciated that the number and spacing of the laser emitter apertures 112 is a design choice based upon the number and pattern of generated laser points 149 desired. Thus, the number of laser emitters 140 set into the laser sight body 110 may vary and is not limited to a certain minimum or maximum number. For example, FIG. 11 shows a second illustrative, non-limiting embodiment of an exemplary laser sighting device 200. It should be understood that the laser sighting device 200 comprises components similar or identical to those described above, with respect to FIGS. 1-8. However, as illustrated in FIG. 11, the laser sighting device 200 comprises a laser sight body 210 that is formed so as to accommodate six laser emitters 240 capable of emitting laser light beams 248 through laser light apertures 220. The laser light apertures 220 are spaced equal distance around the laser sight body 210 so that when the laser emitters 140 are activated, a resulting pattern of six, equally spaced laser points is projected onto a target.

Figure 10:
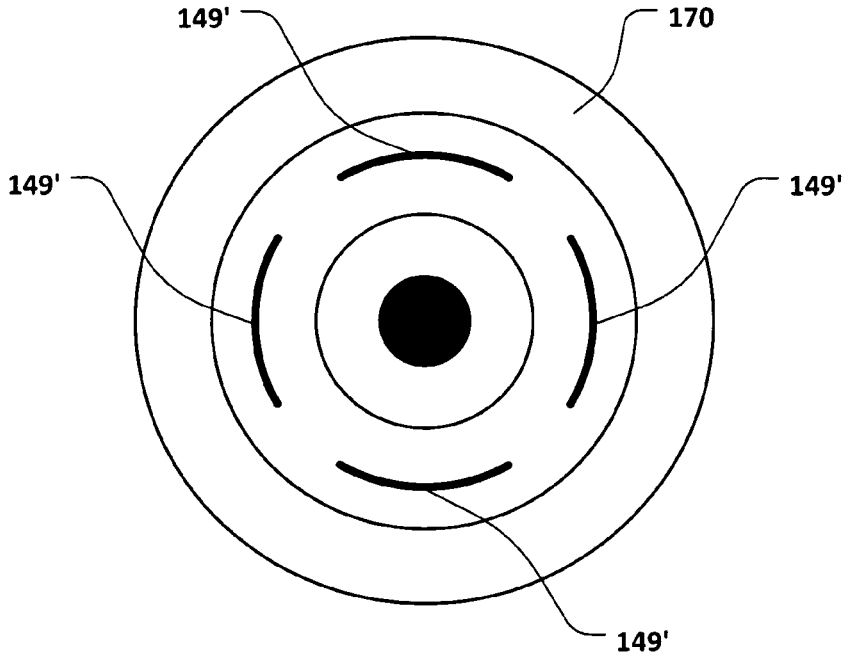
FIG. 10 shows a second illustrative, non-limiting embodiment of an exemplary laser pattern projected on a target according to this invention.

In various exemplary embodiments, prismatic optical enhancements may be positioned within the laser light aperture 120 or the laser emitters 140 may comprise line or pattern generating laser emitters 140. By using optical enhancements and/or line or pattern generating laser emitters 140, a "crosshair" or other pattern may be generated and projected onto a target. For example, as illustrated in FIG. 10, line generating laser emitters that project an arc may be combined so that four arcs 149' are projected onto the target 170. It should be appreciated that any geometric or other shape that can be produced by optical enhancements and/or line or pattern generating laser emitters may be employed. Likewise, it should be understood that the projected laser light beam(s) may be of any color and/or intensity.

Figure 12:
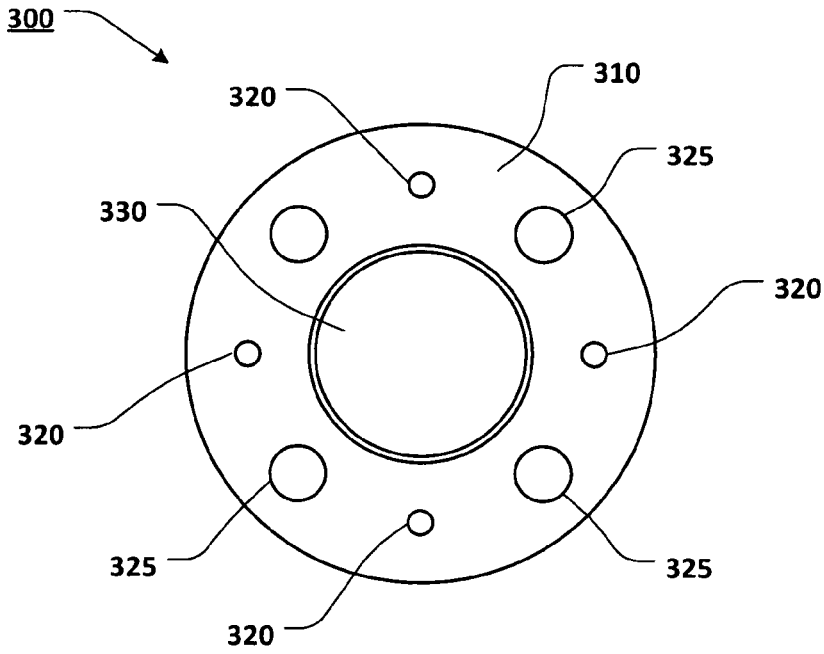
FIG. 12 shows a front view of the third illustrative, non-limiting embodiment of an exemplary laser sighting device according to this invention.

FIG. 12 shows a front view of the third illustrative, non-limiting embodiment of an exemplary laser sighting device 300 according to this invention. It should be understood that the laser sighting device 300 comprises components similar or identical to those described above, with respect to FIGS. 1-8 and/or FIG. 11.

However, as shown in FIG. 12, the laser sighting device 300 includes a plurality of high intensity Light Emitting Diodes (LED) 325 in the alternate spaces between the existing laser light apertures 320 of the laser sight body 310. The LEDs 325 may be of all white light in the visible spectrum, of various colors, or may be in the infrared spectrum. The laser sighting device 300 allows a target to be visually illuminated, thus aiding in the acquisition of proper sight alignment.

Figure 13:
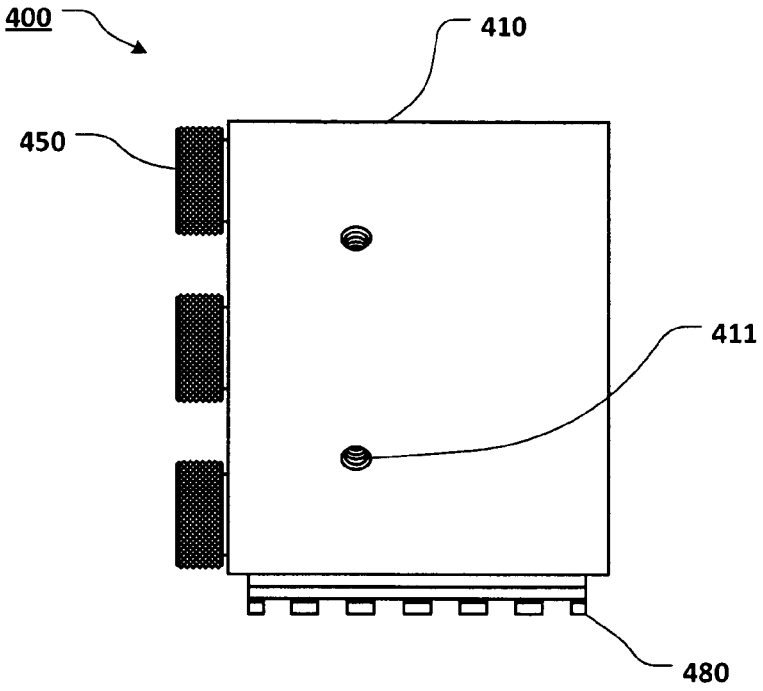
FIG. 13 shows a side view of a fourth illustrative, non-limiting embodiment of an exemplary laser sighting device according to this invention.
Figure 14:
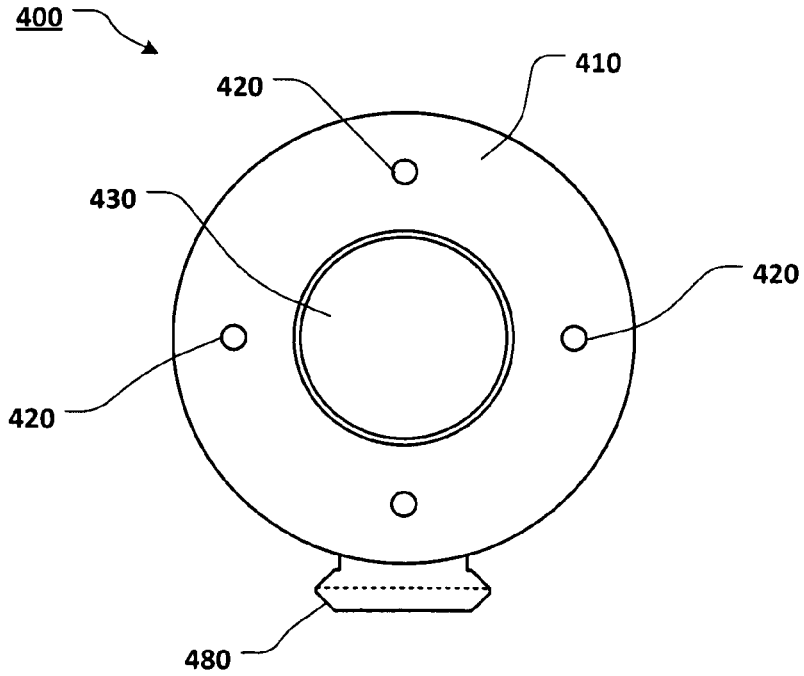
FIG. 14 shows a front view of the fourth illustrative, non-limiting embodiment of an exemplary laser sighting device according to this invention.

FIGS. 13 and 14 show a fourth illustrative, non-limiting embodiment of an exemplary laser sighting device 400 according to this invention. It should be understood that the laser sighting device 400 comprises components similar or identical to those described above, with respect to FIGS. 1-8, FIG. 11, and/or FIG. 12.

However, as shown in FIGS. 13 and 14, the laser sighting device 400 includes an accessory attachment rail 480. In various exemplary embodiments, the accessory attachment rail 480 may comprise one or more standard Picatinny rails. The accessory attachment rail 480 may be formed as an integral component of the laser sight body 410. Alternatively, the accessory attachment rail 480 may be formed as a separate component that is attached or coupled to the laser sight body 410.

Figure 15:
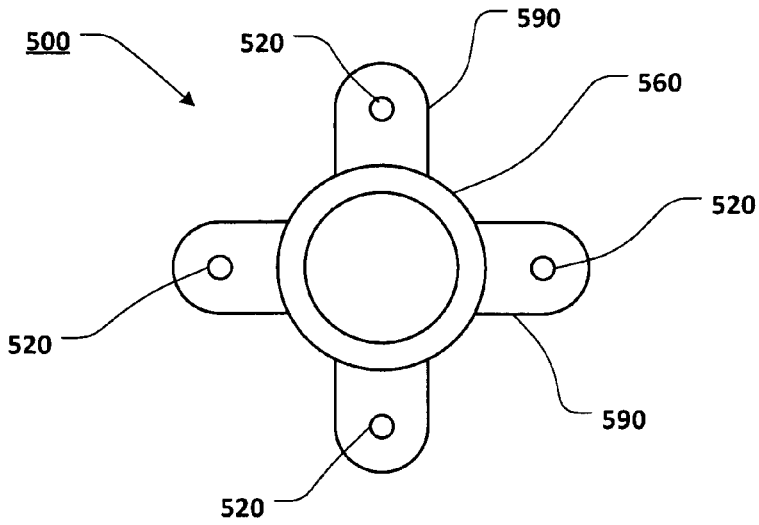
FIG. 15 shows a front view of a fifth illustrative, non-limiting embodiment of an exemplary laser sighting device according to this invention.
Figure 16:
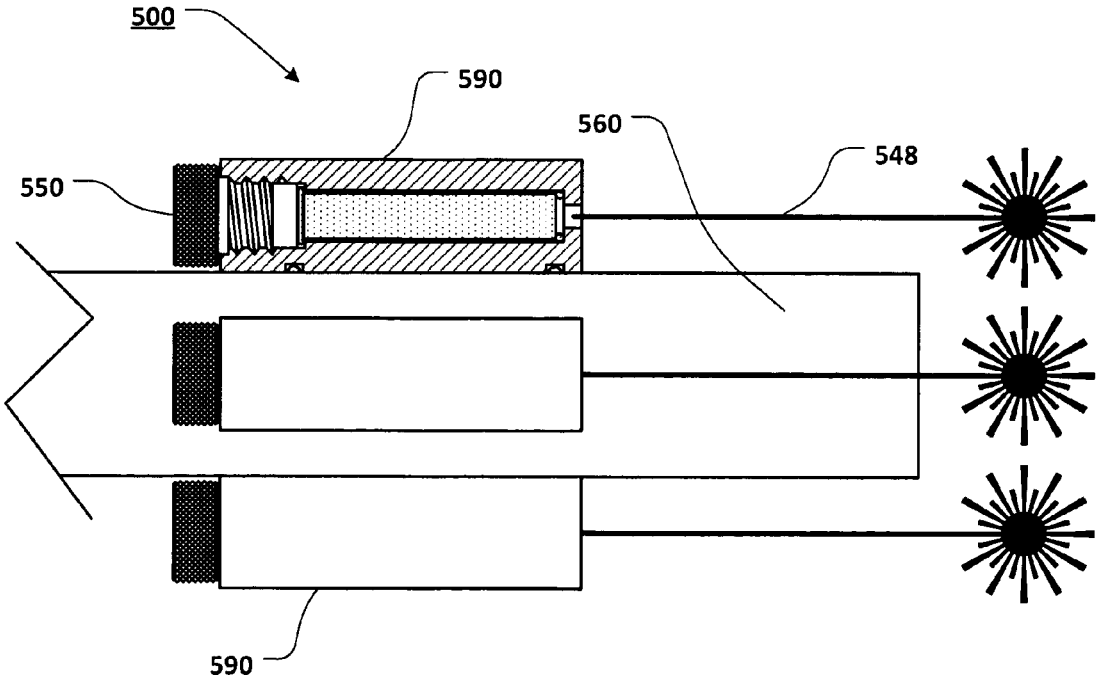
FIG. 16 shows a side view of the fifth illustrative, non-limiting embodiment of an exemplary laser sighting device according to this invention.

FIGS. 15 and 16 show a fifth illustrative, non-limiting embodiment of an exemplary laser sighting device 500, according to this invention. It should be understood that the laser sighting device 500 comprises components similar or identical to those described above, with respect to FIGS. 1-8, FIG. 11, FIG. 12, and/or FIGS. 13 and 14.

However, as shown in FIGS. 15 and 16, the laser sighting device 500 includes a plurality of laser emitter pods 590. Each laser emitter pod 590 is attached, coupled, or formed as an integral component of the barrel 560 and is formed so as to accept a single laser emitter 540.

Figure 17:
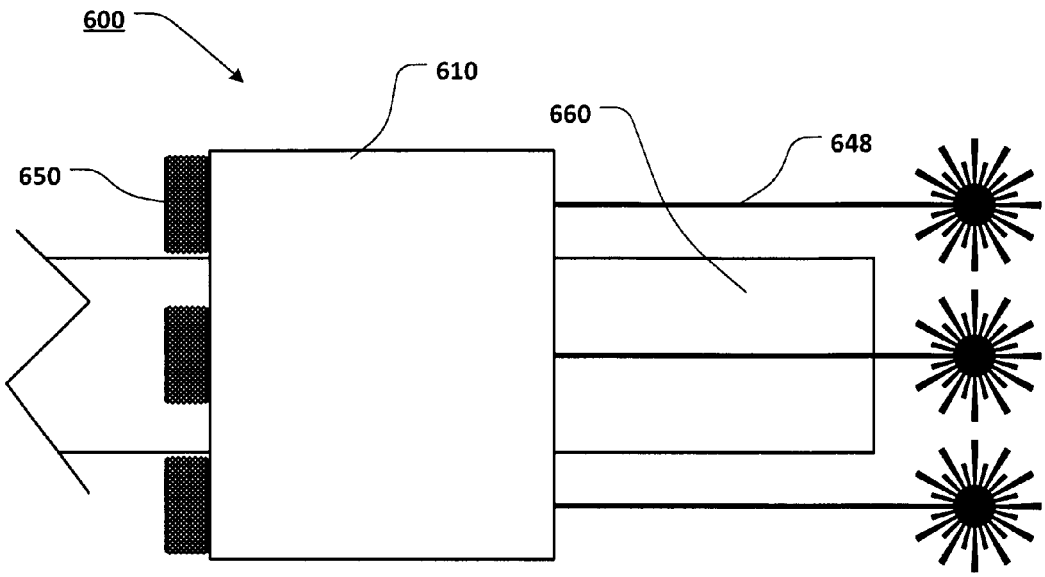
FIG. 17 shows a side view of the sixth illustrative, non-limiting embodiment of an exemplary laser sighting device according to this invention.

FIG. 17 shows a sixth illustrative, non-limiting embodiment of an exemplary laser sighting device 600, according to this invention. It should be understood that the laser sighting device 600 comprises components similar or identical to those described above, with respect to FIGS. 1-8, FIG. 11, FIG. 12, and/or FIGS. 13 and 14.

However, as shown in FIG. 17, the laser sighting device 600 includes a laser sight body 610 that is formed as an integral component of the barrel 660.

Figure 18:
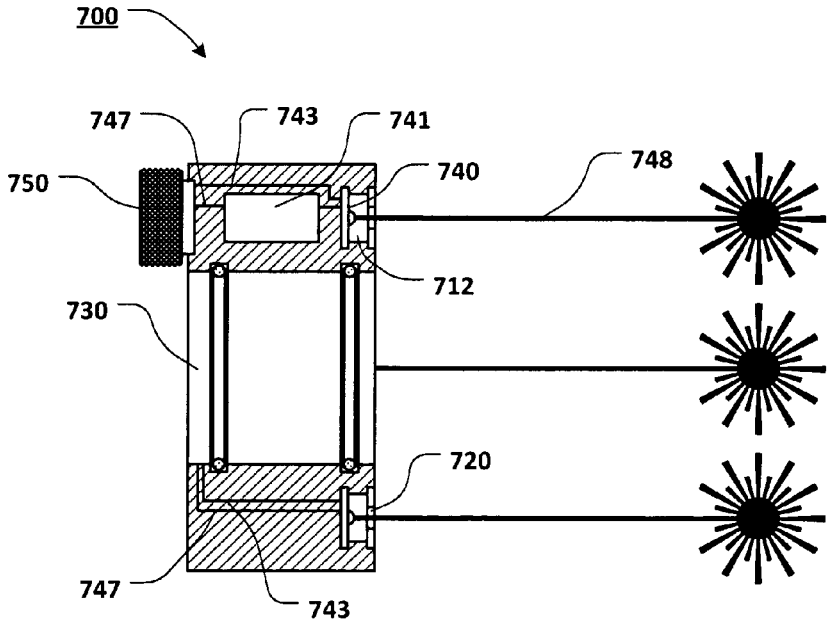
FIG. 18 shows a cross-sectional view of a seventh illustrative, non- limiting embodiment of an exemplary laser sighting device according to this invention.

FIG. 18 shows a cross-sectional view of a seventh illustrative, non-limiting embodiment of an exemplary laser sighting device 700, according to this invention. As illustrated in FIG. 18, the laser emitters 140 are replaced with laser emitting circuits 740 that are positioned within laser emitting circuit apertures 712. The laser emitting circuits 740 are electrically connected, via electrical connections 743 and 747, to a power supply 741 and a switch 750 such that when the switch 750 is in an on position, power is supplied from the power supply 741 to the laser emitting circuits 740 to activate the laser emitting circuits 740 and produce laser light beams 748.

When the switch 750 is in an off position, power is not supplied to the laser emitting circuits 740.

Figure 19:
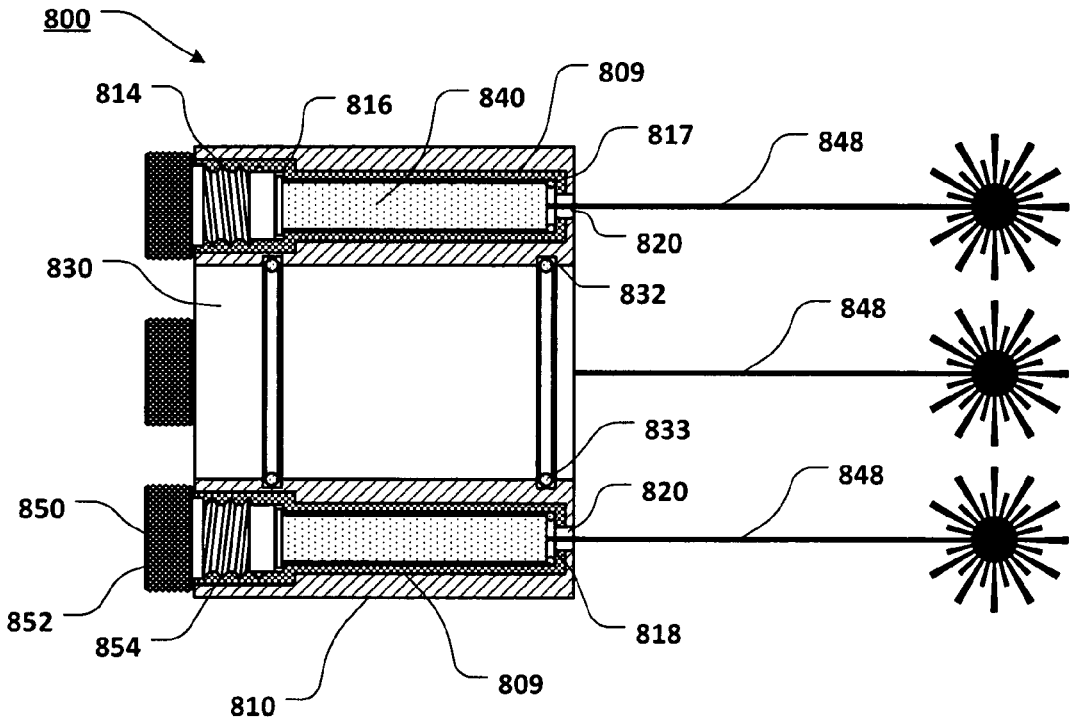
FIG. 19 shows a cross-sectional view of an eighth illustrative, non-limiting embodiment of an exemplary laser sighting device according to this invention.

FIG. 19 shows a cross-sectional view of an eighth illustrative, non-limiting embodiment of an exemplary laser sighting device 800, according to this invention. It should be understood that the laser sighting device 800 may optionally comprise components similar or identical to those described above, with respect to FIGS. 1-17.

However, as illustrated in FIG. 19, a conductive sleeve portion 809 is formed in area surrounding each of the caps 850 and the laser emitters 840 such that each laser emitter aperture 812 is at least partially surrounded by an electrically conductive sleeve portion 809. Each conductive sleeve portion 809 is formed of an electrically conductive material and is secured within the laser sight body 810. It should be appreciated that each conductive sleeve portion 809 may comprise an electrically conductive wire portion, a portion of a sleeve, or a sleeve that completely surrounds the laser emitter aperture 812.

The laser sight body 810 may formed of a substantially electrically conductive material or a substantially electrically non-conductive material.

While this invention has been described in conjunction with the exemplary embodiments outlined above, it is evident that many alternatives, modifications, and variations will be apparent to those skilled in the art. For example, the laser emitters described above may be replaced by laser emitters that are controlled by electric, electro-mechanical, or mechanical switches. Likewise, laser emitters that have an external power source and/or operational control switches may also be used.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A laser sighting device, comprising:

a laser sight body having a barrel aperture formed through said laser sight body, wherein said barrel aperture is parallel to a longitudinal axis of said laser sight body;

two or more laser emitter apertures formed in said laser sight body, wherein each laser emitter aperture extends from a threaded portion to a shoulder to a bottom wall, and wherein each laser emitter aperture includes a spring biasing means positioned so as to contact said bottom wall;

a laser light aperture extending from said bottom wall of each laser emitter aperture through said laser sight body, wherein each laser emitter aperture and each laser light aperture has a longitudinal axis that is parallel to said longitudinal axis of said laser sight body;

two or more laser emitters, wherein each laser emitter includes a laser emitter rim and a laser emitter body, wherein each laser emitter is constructed such that an exterior surface of said laser emitter rim is electrically isolated from an exterior surface of said laser emitter body such that when said exterior surface of said laser emitter rim is electrically connected to said exterior surface of said laser emitter body, said laser emitter is activated and a laser light beam is projected from said laser emitter;

wherein a laser emitter is fitted within each laser emitter aperture such that said exterior surface of said laser emitter body contacts a side wall of said laser emitter aperture, and wherein a forward surface of said laser emitter body contacts said spring biasing means at said bottom wall of said laser emitter aperture and said laser emitter is spring biased, via said spring biasing means, such that said laser emitter rim does not make contact with said shoulder of said laser emitter aperture;

a cap associated with each laser emitter aperture, wherein each cap extends from a top portion to a threaded portion to an end surface, and wherein each cap is formed such that said threaded portion of said cap can be threaded into said threaded portion of said laser emitter aperture;

wherein when a cap is a threadedly connected, via interaction of said threaded portion of said cap and said threaded portion of said laser emitter aperture, said end surface of said cap makes contact with a rear surface of said laser emitter, such that when sufficient tightening, rotational torque is applied to said cap said spring bias of said spring biasing means is overcome sufficient to allow said laser emitter be urged within said laser emitter aperture such that said exterior surface of said laser emitter rim makes contact with said shoulder of said laser emitter aperture, thereby completing an electrical path between said exterior surface of said laser emitter rim and said exterior surface of said laser emitter body such that said laser emitter produces a laser light beam that is projected through said laser light aperture.

2. The laser sighting device of claim 1, wherein said barrel aperture is formed through an approximate center of said laser sight body.

3. The laser sighting device of claim 1, wherein said laser sight body is formed of an electrically conductive material.

4. The laser sighting device of claim 1, wherein said laser sight body is formed of an electrically non-conductive material and each laser emitter aperture is at least partially surrounded by an electrically conductive sleeve portion.

5. The laser sighting device of claim 1, wherein said laser sight body is formed of a first material and each laser emitter aperture is at least partially surrounded by an electrically conductive sleeve portion.

6. The laser sighting device of claim 1, wherein said spring biasing means comprises one of an O-ring or a spring washer.

7. The laser sighting device of claim 1, wherein each laser light aperture is of a sufficient diameter to allow a laser light beam to be projected through said laser light aperture and out of said laser sight body.

8. The laser sighting device of claim 1, wherein each laser emitter is a rimfire-type laser bore sight.

9. The laser sighting device of claim 1, wherein each laser emitter aperture is formed such that a laser emitter can be fitted within each laser emitter aperture.

10. The laser sighting device of claim 1, wherein at least one O-ring receiving groove is formed within said barrel aperture and wherein an O-ring is positioned within said at least one O-ring receiving groove.

11. The laser sighting device of claim 1, wherein at least one threaded set screw apertures is formed in said laser sight body, wherein said at least one threaded set screw aperture extends radially from a center of said laser sight body.

12. The laser sighting device of claim 1, wherein each projected laser light beam is parallel to said longitudinal axis of said laser sight body.

13. The laser sighting device of claim 1, wherein said laser emitter apertures are positioned at equally spaced apart positions around said laser sight body.

14. The laser sighting device of claim 1, wherein a prismatic optical enhancement is positioned within said laser light aperture.

15. The laser sighting device of claim 1, wherein at least one of said laser emitters is a line or pattern generating laser emitter.

16. The laser sighting device of claim 1, wherein said laser sight body includes a plurality of Light Emitting Diodes.

17. The laser sighting device of claim 1, wherein said laser sight body includes at least one accessory attachment rail.

18. The laser sighting device of claim 1, wherein said laser sight body is formed as an integral component of a barrel.

19. A laser sighting device, comprising:

two or more laser emitter pods formed as an integral component of a barrel, wherein said barrel is parallel to a longitudinal axis of each laser emitter pod;

a laser emitter aperture formed in each laser emitter pod, wherein each laser emitter aperture extends from a threaded portion to a shoulder to a bottom wall, and wherein each laser emitter aperture includes a spring biasing means positioned so as to contact said bottom wall;

a laser light aperture extending from said bottom wall of each laser emitter aperture through each laser emitter pod, wherein each laser emitter aperture and each laser light aperture has a longitudinal axis that is parallel to said longitudinal axis of each laser emitter pod;

two or more laser emitters, wherein each laser emitter includes a laser emitter rim and a laser emitter body, wherein each laser emitter is constructed such that an exterior surface of said laser emitter rim is electrically isolated from an exterior surface of said laser emitter body such that when said exterior surface of said laser emitter rim is electrically connected to said exterior surface of said laser emitter body, said laser emitter is activated and a laser light beam is projected from said laser emitter;

wherein a laser emitter is fitted within each laser emitter aperture such that said exterior surface of said laser emitter body contacts a side wall of said laser emitter aperture, and wherein a forward surface of said laser emitter body contacts said spring biasing means at said bottom wall of said laser emitter aperture and said laser emitter is spring biased, via said spring biasing means, such that said laser emitter rim does not make contact with said shoulder of said laser emitter aperture;

a cap associated with each laser emitter aperture, wherein each cap extends from a top portion to a threaded portion to an end surface, and wherein each cap is formed such that said threaded portion of said cap can be threaded into said threaded portion of said laser emitter aperture;

wherein when a cap is a threadedly connected, via interaction of said threaded portion of said cap and said threaded portion of said laser emitter aperture, said end surface of said cap makes contact with a rear surface of said laser emitter, such that when sufficient tightening, rotational torque is applied to said cap said spring bias of said spring biasing means is overcome sufficient to allow said laser emitter be urged within said laser emitter aperture such that said exterior surface of said laser emitter rim makes contact with said shoulder of said laser emitter aperture, thereby completing an electrical path between said exterior surface of said laser emitter rim and said exterior surface of said laser emitter body such that said laser emitter produces a laser light beam that is projected through said laser light aperture; and wherein each projected laser light beam is parallel to said longitudinal axis of each laser emitter pod.

20. A laser sighting device, comprising:

a body having an aperture formed therethrough, wherein said aperture is parallel to a longitudinal axis of said body;

two or more laser emitter apertures formed in said body;

a laser light aperture extending from each laser emitter aperture through said body;

a laser emitting circuit positioned within each laser emitter aperture, wherein each laser emitting circuit is electrically connected, via electrical connections, to a power supply and a switch such that when said switch is in an on position, power is supplied from said power supply to each of said laser emitting circuits to activate said laser emitting circuits and produce a laser light beam from each of said laser emitting circuits, and wherein said produced laser light beams are parallel to one another.

* * * * *